US006811496B2

(12) United States Patent
Wahl et al.

(10) Patent No.: US 6,811,496 B2
(45) **Date of Patent: *Nov. 2, 2004**

(54) GOLF CLUB HEAD

(75) Inventors: Bret Wahl, Carlsbad, CA (US); Todd P. Beach, San Diego, CA (US); Benoit Vincent, Leucadia, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/234,663

(22) Filed: Sep. 3, 2002

(65) Prior Publication Data

US 2003/0032499 A1 Feb. 13, 2003

Related U.S. Application Data

(63) Continuation-in-part of application No. 09/728,955, filed on Dec. 1, 2000, now Pat. No. 6,592,468.

(51) Int. Cl.[7] ..... A63B 53/04

(52) U.S. Cl. ..... 473/334; 473/338; 473/345; 473/350

(58) Field of Search ..... 473/324, 326, 473/329, 332, 334, 335, 336, 337, 338, 339, 345, 347, 348, 349, 350, 219, 226, 242, 256, 290, 291, 292, 346; 273/DIG. 8

(56) References Cited

U.S. PATENT DOCUMENTS

| | | | |
|---|---|---|---|
| 1,538,312 | A | 5/1925 | Beat |
| 2,163,091 | A | 6/1939 | Held |
| 2,198,981 | A | 4/1940 | Sullivan |
| 2,328,583 | A | 9/1943 | Reach |
| 2,332,342 | A | 10/1943 | Reach |
| 2,429,351 | A | 10/1947 | Fetterolf |
| D207,228 | S | 3/1967 | Solheim |
| 3,466,047 | A | 9/1969 | Rodia et al. |
| 3,606,327 | A | 9/1971 | Gorman |

(List continued on next page.)

FOREIGN PATENT DOCUMENTS

| | | |
|---|---|---|
| GB | 2200558 | 8/1988 |
| JP | 53-71936 | 6/1978 |
| JP | 02-084972 | 3/1990 |
| JP | 10-127832 | 5/1998 |
| JP | 2001-000599 | 1/2001 |
| JP | 2001-037920 | 2/2001 |
| JP | 2001-046560 | 2/2001 |
| JP | 2001-095959 | 4/2001 |
| JP | 2001-204863 | 7/2001 |
| WO | WO 02/43819 | 6/2002 |

OTHER PUBLICATIONS

The Golf Works 1991 Full Line Catalog.
1997 Golf Catalog, "Ti Cu Titan Cavity".
2000 Autumn Golf Clubs & Goods Catalogue, "Guiness World Records MCavity," p. 40.
Yamaha, "Grandis 620".
Edwin Watts Golf Catalog, Summer 2002, "Deep Red Fat Shaft Irons," Item #5997.

*Primary Examiner*—Sebastiano Passaniti
(74) *Attorney, Agent, or Firm*—Sheppard, Mullin, Richter & Hampton, L.L.P.

(57) ABSTRACT

A golf club head is disclosed that comprises a body having a striking face, a rear cavity and a sole bar, wherein a recess is formed in the sole bar that extends generally from the rear cavity. An insert is located within the sole recess, the insert including a core and an intermediate layer that separates the core from the recess wall. The intermediate layer has a hardness and a modulus of elasticity that are less than that of the core, such that when the golf club head is used to strike a golf ball, the resulting vibrations are dissipated by compression of the intermediate layer and movement of the core with respect to the intermediate layer.

17 Claims, 11 Drawing Sheets

U.S. PATENT DOCUMENTS

| | | | | | |
|---|---|---|---|---|---|
| 4,043,563 | A | | 8/1977 | Churchward | |
| D246,329 | S | | 11/1977 | Little | |
| 4,085,934 | A | | 4/1978 | Churchward | 273/171 |
| 4,340,230 | A | | 7/1982 | Churchward | 273/171 |
| 4,398,965 | A | | 8/1983 | Campau | 148/3 |
| 4,695,054 | A | | 9/1987 | Tunstall | 273/171 |
| 5,050,879 | A | | 9/1991 | Sun et al. | 273/80 A |
| 5,176,384 | A | * | 1/1993 | Sata et al. | 473/329 |
| 5,316,305 | A | | 5/1994 | McCabe | 273/174 |
| 5,385,348 | A | | 1/1995 | Wargo | 273/171 |
| 5,492,327 | A | | 2/1996 | Biafore, Jr. | 273/173 |
| 5,669,826 | A | | 9/1997 | Chang et al. | |
| 5,833,551 | A | | 11/1998 | Vincent et al. | 473/350 |
| 6,045,456 | A | | 4/2000 | Best et al. | 473/291 |
| 6,077,171 | A | | 6/2000 | Yoneyama | 473/291 |
| 6,086,485 | A | | 7/2000 | Hamada et al. | |
| 6,206,790 | B1 | | 3/2001 | Kubica et al. | |
| 6,210,290 | B1 | * | 4/2001 | Erickson et al. | 473/345 |
| 6,409,612 | B1 | | 6/2002 | Evans et al. | |
| 6,458,044 | B1 | * | 10/2002 | Vincent et al. | 473/334 |
| 6,592,468 | B2 | * | 7/2003 | Vincent et al. | 473/334 |
| 6,616,547 | B2 | * | 9/2003 | Vincent et al. | 473/334 |

* cited by examiner

GOLF CLUB HEAD

CROSS-REFERENCE TO RELATED APPLICATION

This is a continuation-in-part of application Ser. No. 09/728,955, filed Dec. 1, 2000 now U.S. Pat. No. 6,592,468.

BACKGROUND OF THE INVENTION

The present invention relates generally to the golf clubs and, more particularly, to golf club heads.

Modern golf clubs have typically been classified as either woods, irons or putters. The term "wood" is a historical term that is still commonly used, even for golf clubs that are constructed of steel, titanium, fiberglass or other more exotic materials, to name a few. The term "iron" is also a historical term that is still commonly used, even though those clubs are not typically constructed of iron, but are rather constructed of many of the same materials used to construct "woods".

Many advancements have been achieved, particularly over the past couple of decades, to make it easier to hit longer and straighter shots with woods and irons. In general, golf clubs are now designed to be more forgiving, so that shots that are struck less than perfectly will still have fairly consistent distance and directional control. Moreover, club heads now commonly are constructed of combinations of materials, to attempt to optimize the ball flight desired by a particular type of player.

One particular improvement that relates to irons is the use of perimeter weighting, whereby a disproportionate amount of the total weight of a club head is positioned behind and proximate the perimeter of the club head's striking face, thereby creating a cavity immediately behind the striking face. The cavity is formed by the club face wall and the weight that is placed around and behind the club face. This type of club is typically referred to as a "cavity back" iron. By moving the weight peripherally away from the center of gravity (CG) of the club head, the club is made to be more forgiving on off-center hits, resulting in more consistent distance and directional control. Further, perimeter weighting generally increases the moment of inertia about the club's CG, resulting in less twisting due to off-center hits, and more accurate shots.

There are so-called "hollow" irons that incorporate a rear wall that is spaced from the front striking face. This also increases the moment of inertia about the club's CG and is found to benefit some higher handicap golfers. Some hollow irons more closely resemble fairway woods in cross-sectional shape, while other hollow irons may resemble cavity back irons in their cross-section.

Another improvement is the use of lighter and stronger materials, which enables club designers to move the CG to an optimal location on a wood or iron. Such a movement can make the club either easier to hook or to fade, if the movement is made either closer to or farther from the hosel. Similarly, if the CG is moved higher or lower with respect to the club face, the golf ball launch conditions can be altered. For instance, lowering the CG generally makes it easier to get the ball airborne for either an iron or a wood. Conversely, raising the CG promotes a more boring ball flight that generally leaves the club face at a lower launch angle.

Generally, it has been shown that it can be advantageous for players with higher handicaps to use clubs with a lower CG. This is especially true for long irons, such as for example a 3-iron. Club designers have responded to this prospective advantage by lowering the CG of both woods and irons for clubs intended for higher handicap players. The most common way that this has been accomplished for irons is to move as much weight as possible to the area proximate the sole of the club. This results in a concentration of weight proximate the sole. Often, for these types of irons, the transition from the cavity to the weight on the sole is abrupt, compared to traditional irons having a smoother transition. When viewing a cross-section of the lower portion of the club face, a dramatic change in the thickness of the face nearer the sole often is apparent in such sole-weighted club heads.

While it is recognized that the lower CG of the improved clubs can be beneficial, such a lowering can have negative side effects. First, the concentrated mass proximate the sole can increase the stiffness of the club head. This can cause a noticeable change in the club's feel. Feel is a term that is generally used by skilled practitioners to denote a subjective expression of the way a club feels to one's hands when striking a golf ball, or the way it sounds. Feel is generally perceived as audible to tactile feedback to the golfer. Different sensations due to striking the ball in different locations on the club face may make a club less desirable to a potential user.

Second, the weight concentration proximate the sole can lead to different levels of flex at different points on the club face. The area of the face proximate the thickest portion of the sole is likely to flex less than the area proximate the inner areas of the striking face. Such a change in flex can adversely affect performance.

Third, the weight concentration can lead to excess vibration, which can adversely affect the feel of the golf club, including the sound made by the club.

It should be appreciated from the foregoing description that there is a need for an improved golf club head that creates a more consistent flex when striking the ball, improves the club's feel, and reduces vibration. The present invention satisfies this need and provides further related advantages.

SUMMARY OF THE INVENTION

The present invention provides a solution to counteract the negative side effects described above, by allowing club designers to design a club with an optimal center of gravity, while at the same time lowering the stiffness proximate the sole, creating more consistent flex while striking the ball, improving the feel of the club and reducing vibration.

According to a preferred embodiment, a golf club head has a body with a striking face, a rear cavity, a hosel and a sole portion. The rear cavity has a cavity wall and a cavity rim, and a recess having a wall is formed proximate the rear cavity. The recess extends generally from the rear cavity toward a bottom of the sole portion. An insert is located within the recess and includes a core and an intermediate layer that at least partially separates the core from the recess wall. The intermediate layer has a hardness and a modulus of elasticity that are less than that of the core, such that when the golf club head is used to strike a golf ball, the resulting vibrations are dissipated by compression of the intermediate layer and friction between the core and the intermediate layer.

In another preferred embodiment, a golf club head has a body with a striking face, a rear cavity and a sole portion. A recess is formed in the rear cavity and extends generally toward a bottom of the sole portion. There is at least one aperture formed proximate the recess and extending generally from the recess toward the bottom of the sole portion. A cell is inserted within the aperture and has a pin and an outer sleeve. The sleeve has a hardness and a modulus of elasticity that are less than that of the pin, such that when the golf club head is used to strike a golf ball, the resulting vibrations are dissipated by compression of the sleeve and friction between the pin and the sleeve.

Yet another preferred embodiment includes a main body having a front perimeter, a hosel, a rear portion forming a rear cavity and a sole portion. A first recess is formed in the sole portion and extends generally from the rear cavity toward a bottom of the sole portion. The first recess has a recess wall. A striking face is attached to the front perimeter of the main body, and a hollow portion is formed between the striking face and a wall of the rear cavity. A core and an intermediate layer are located within the first recess, with the intermediate layer at least partially separating the core from the recess wall. A weight is located in the sole portion having a density greater than or equal to a density of the core. The intermediate layer has a hardness and a modulus of elasticity that are less than that of the core, such that when the golf club head is used to strike a golf ball, the resulting vibrations are dissipated by compression of the intermediate layer.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1:
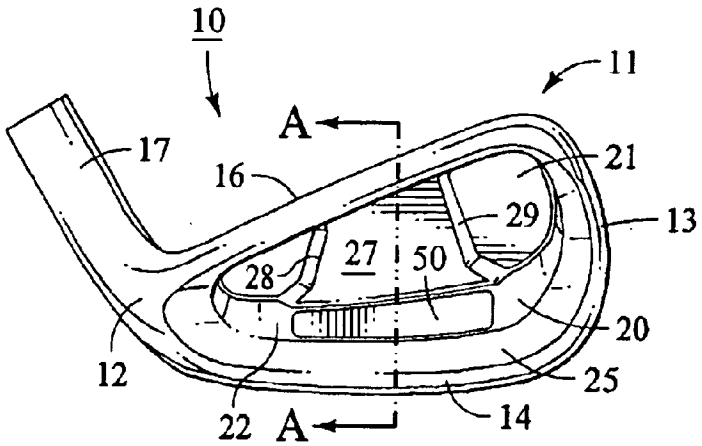
FIG. 1 is a rear view of a first preferred embodiment of a golf club head in accordance with the invention.
Figure 1A:
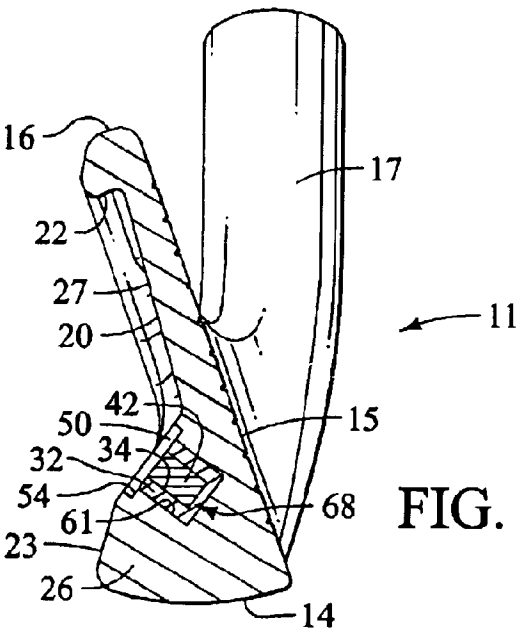
FIG. 1A is a cross-sectional view of the golf club head of FIG. 1, viewed along line A—A, depicting an insert assembly in the recess in the cavity rim and sole bar.

Referring now to a first embodiment of the present invention shown in FIGS. 1 and 1A, there is shown a golf club head 10 that is similar to many cavity back club heads that are known in the art. The club head 10 includes a body 11 having a heel 12, a toe 13, a sole 14, a front striking face 15, a top line 16, and a hosel 17. The body 11 also has a rear cavity 20 that has a cavity wall 21 that is substantially parallel to the striking face 15.

The cavity 20 includes a cavity rim 22 that extends substantially rearwardly from the cavity wall 21 proximate the heel 12, toe 13, sole 14 and top line 16, as shown in FIGS. 1 and 1A. The club head 10 has a perimeter weighting 25 that comprises a mass of material that extends rearwardly from the entirety or a portion of the perimeter of the club head proximate the cavity rim 22. The perimeter weighting 25 includes a sole bar 26 or mass concentration located proximate the sole 14 so as to provide the desired weight distribution characteristics.

The perimeter weighting 25 may take various shapes as it wraps from a perimeter of the striking face 15 to the cavity rim 22. As shown in FIG. 1A, a cavity transition 23 is located between the cavity rim 22 and the sole 14. The transition 23 may be radiused or may comprise a series of planar surfaces. The body 11 has a raised cavity center weight 27 that protrudes rearwardly from the cavity wall 21 and that is defined by cavity step downs 28, 29, toward the heel 12 and toe 13, respectively. Alternatively, the cavity wall 21 could be substantially flat (see FIG. 5) or have other shapes to create different performance characteristics and different weight distribution.

The body 11 is preferably formed of a cast stainless steel, although other known materials known to those skilled in the art may be used. The striking face 15 may be integrally cast with the body 11, or it may be separately formed and attached to a main body portion 11' comprising the heel 12, toe 13, top line 16, sole 14, and hosel 17 (see FIGS. 5A, 6 and 7). Alternatively, the striking face 15 may be integrally cast or forged with the hosel 17 (not shown) and attached to the remainder of the club head body 11. A preferred attachment method for the striking face 15 is welding, although other methods known to those skilled in the art may be used.

Figure 1B:
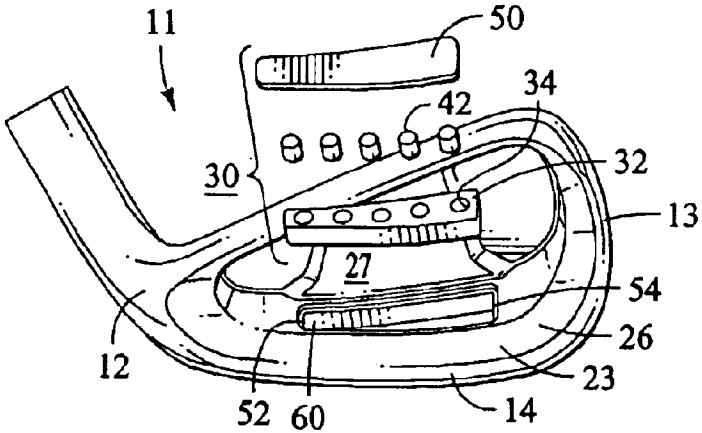
FIG. 1B is an exploded view of the golf club head of FIG. 1.

As shown in FIGS. 1A and 1B, the body 11 has a recess 60 formed in the sole bar 26 proximate the cavity rim 22. A preferred method of forming the recess is by casting the recess 60 with the body 11, although the recess 60 may also be machined into the cast body 11. The recess 60 extends longitudinally between the heel 12 and the toe 13. The recess 60 preferably extends downwardly and slightly forward toward the striking face 15 for ease of manufacturing. The recess 60 is defined by a recess wall 61 and a bottom 68. The bottom 68 of the recess 60 is preferably distanced from the outer surface of the striking face 15 by at least the minimum thickness of the cavity wall 21.

An insert assembly 30 is located in the recess 60, as shown in FIGS. 1A and 1B. The assembly 30 includes a cartridge 32 having apertures 34 that closely receive a plurality of pins 42. A badge 50 is used to cover the cartridge 32 and pins 42. Five similarly sized pins 42 are included in the assembly 30 and span a lower central region of the cavity rim 22 proximate the center weight 27.

More or less pins 42, having similar or different shapes, volumes and densities, may be substituted according to the vibration damping, stiffness, feel and weight distribution characteristics that are desired. For ease of manufacture, the pins are preferably cylindrical; however, alternative shapes such as cubes or the like may be used. The apertures are sized and shaped according to the dimensions of the pins. A single pin having a rectangular cross-section generally conforming to the shape of the recess may also be used in the cartridge of the assembly.

The cartridge 32 is formed of an elastomer, including, for example, thermoplastic materials such as urethane. Other materials may be utilized, so long as the material has a hardness and a modulus of elasticity that are lower than that of the pins 42. The shape and size of the cartridge may be adjusted according to the desired performance characteristics mentioned previously. The cartridge may be constructed of a translucent material allowing the pins 42 to be visible (see FIG. 4).

The preferred pin 42 may be constructed of tungsten, nickel, aluminum or stainless steel, for example. Other materials may be used, so long as the material is sufficiently dense and has a relatively high modulus of elasticity. The pin 42 is preferably constructed of material having a density at least as high as the material of the body 11 and may be higher than the material forming the striking face 15. Preferably, a shallow recess 52 is provided proximate the upper end of the recess wall 61. A shoulder 54 is formed and receives the badge 50. The depth of the recess 52 is preferably such that the exterior, visible surface of the badge 50 is flush with the cavity rim 22 when the badge is seated on the shoulder 54. It is understood, however, that the recess 52 may be omitted and the badge 50 may be placed directly atop the assembly 30 and either raised from or flush with the cavity rim 22. An adhesive may be used to secure the badge 50 over the recess 52 and/or the assembly 30. In addition, an intermediate layer of metal or plastic material (not shown) may be used between the badge 50 and the insert 30.

The badge 50 may be decorative as well as functional. For example, the badge may be constructed of a translucent material allowing the assembly 30 to be viewed through the badge 50. Or, slits or cutouts may be provided on the badge 50 to allow viewing of the assembly 30. Alternatively, the badge 50 may include embossing, engraving or the like, as known to those skilled in the art. As such, metals such as nickel as well as plastic materials may be used for the badge 50.

Figure 2:
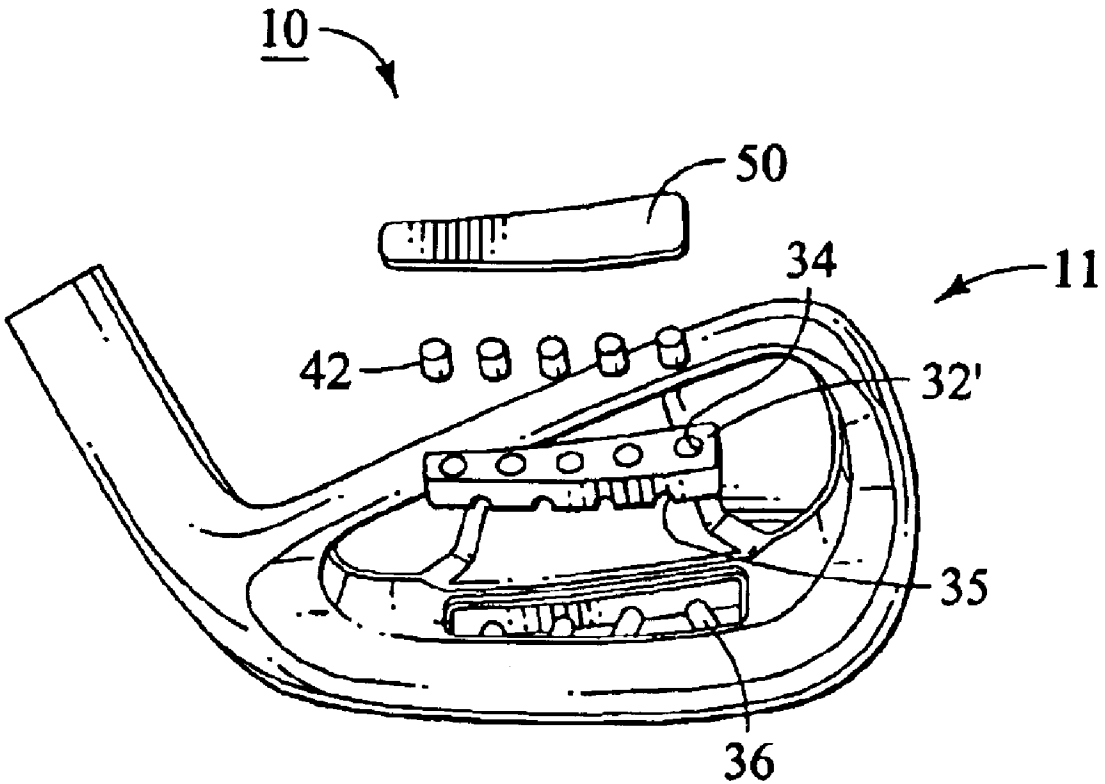
FIG. 2 is an exploded view of a second preferred embodiment of a golf club head similar to FIG. 1.

A second preferred embodiment is shown in FIG. 2 and has grooves 35 formed along a bottom of the cartridge 32'. Corresponding ribs 36 are formed on the bottom 68 and are received in the corresponding grooves 35. The ribs may be used to reinforce the lower region of the striking face 15, add some additional mass in the sole bar 16, and/or aid in securing the cartridge 32' by providing additional surface area for an adhesive, if used.

Figure 3:
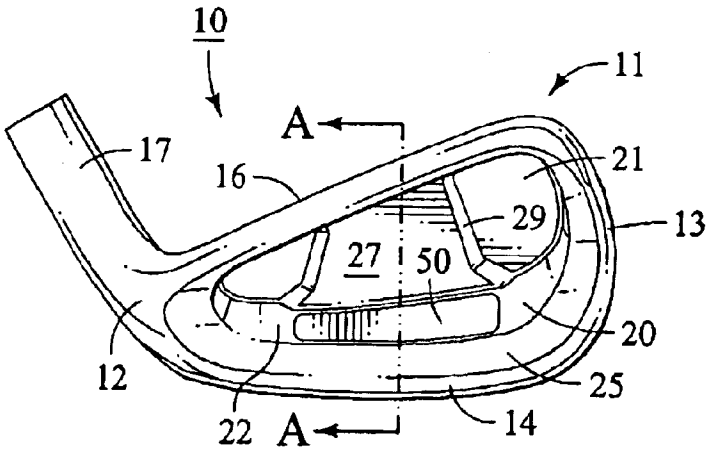
FIG. 3 is a rear view of a third preferred embodiment of a golf club head in accordance with the invention.
Figure 3A:
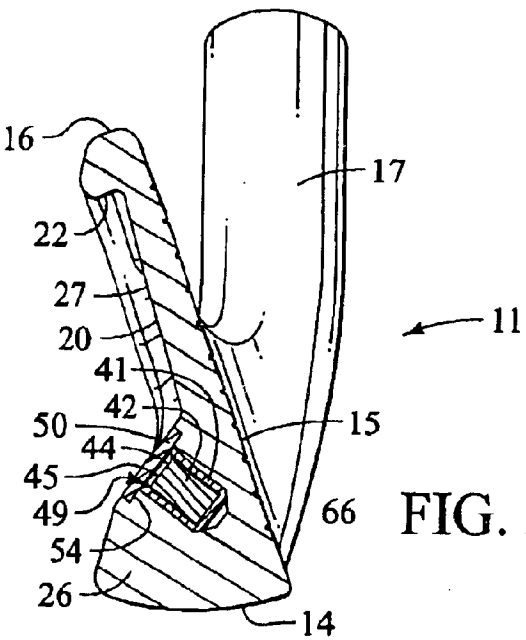
FIG. 3A is a cross-sectional view of the golf club head of FIG. 3, viewed along line A—A, depicting an insert assembly in the recess in the cavity rim and sole bar.
Figure 3B:
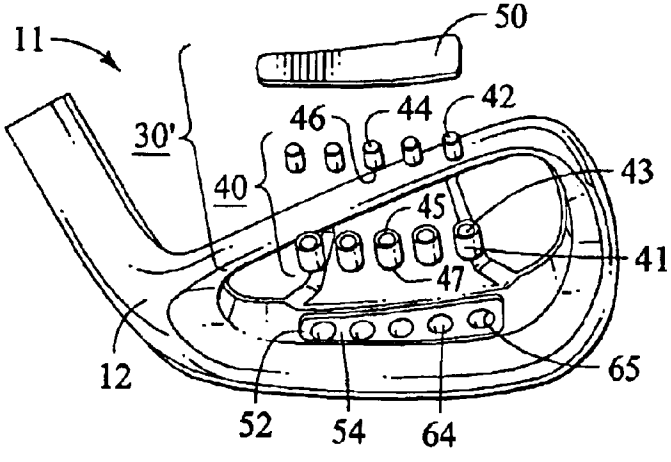
FIG. 3B is an exploded view of the golf club head of FIG. 3.

Another preferred embodiment shown in FIGS. 3, 3A and 3B has an insert assembly 30' that includes cells 40 that are inserted into separate apertures 64 formed in the sole bar 26. Each cell includes a pin 42 that fits into an aperture 43 at a proximal end 45 of a sleeve 41. References to the embodiments described herein use like numerals to refer to like elements and their descriptions. In this embodiment the plurality of sleeves 41 are similar in material and function as the single cartridge 32 of the prior embodiment. Instead of a single recess 60, the plurality of apertures 64 are formed along a similar region as shown by referring to FIGS. 1 and 3. Again, a badge 50 is preferably used to cover the cells 40 of the assembly 30'.

As shown in FIG. 3B, each pin 42 has a proximal end 44 and a distal end 46. Each sleeve 41 has its aperture 43 sized to easily accept a pin 42. The sleeve 41 has an open proximal end 45 and a closed distal end 47. The length of the sleeve 41 is about the same as the length of the pin 42 so that the distal end 46 of the pin 42 may contact the interior of the distal end 47 of the sleeve 41. A lip 49 at the proximal end 45 of the sleeve 41 may be used to capture the proximal end 44 of the pin 42 and aid in its retention prior to the insertion of the cell 40 into the aperture 64.

Referring now to FIG. 3A, it may be seen that the cell 40 preferably does not contact a bottom 66 of the aperture 64. Also, the proximal ends 44, 45 of the pin 42 and sleeve 41, respectively, are spaced slightly below the badge 50. The badge 50 is supported in the shallow recess 52 by shoulder 54. This construction is helpful during the manufacture of the club head.

Figure 4:
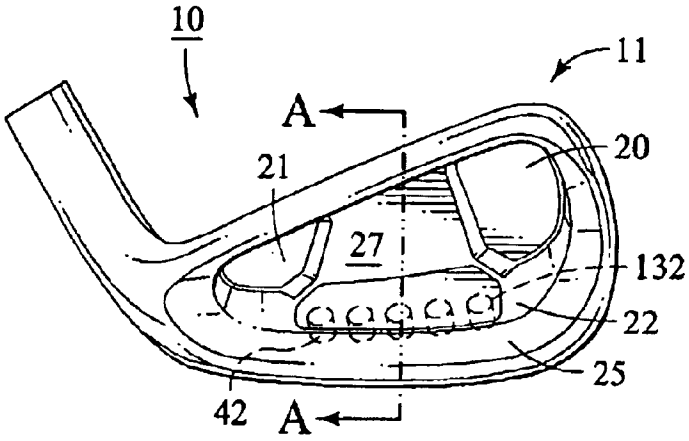
FIG. 4 is a rear view of a fourth preferred embodiment of a golf club head in accordance with the invention.
Figure 4A:
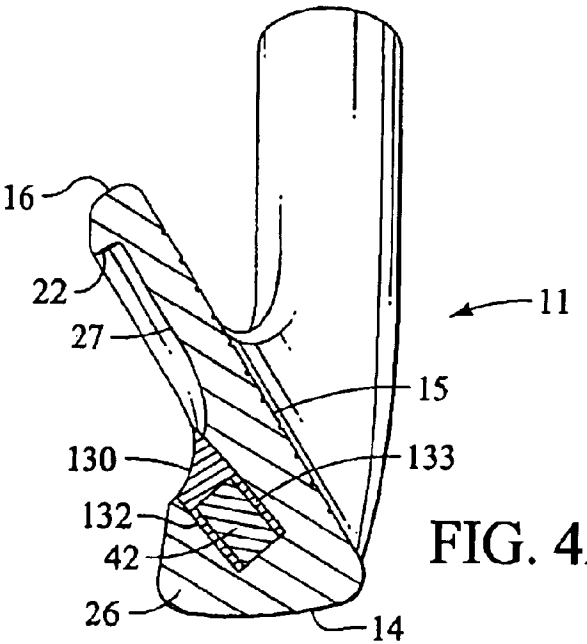
FIG. 4A is a cross-sectional view of the golf club head of FIG. 4, viewed along line A—A, depicting an insert assembly in the recess in the cavity rim and sole bar.
Figure 4B:
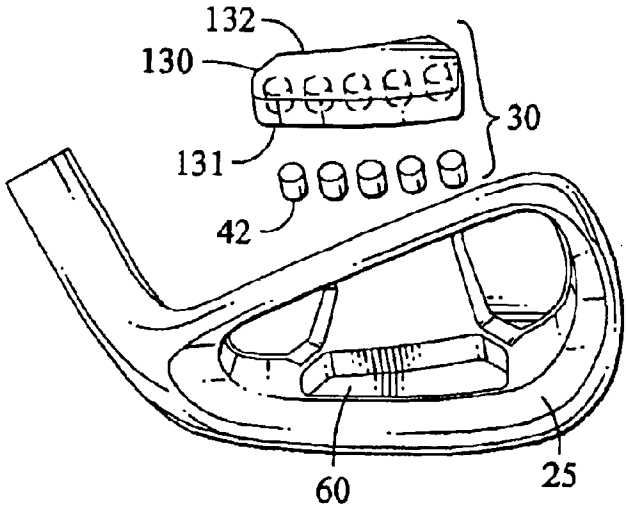
FIG. 4B is an exploded view of the golf club head of FIG. 4.

An alternative embodiment for a club head in accordance with the present invention is shown in FIGS. 4, 4A and 4B. A cartridge 132 includes an upper portion 130 that extends onto a lower portion of the center weight 27 and is uncovered. The pins 42 of the assembly 30 are embedded in holes 131 through a lower portion 133 of the cartridge 132 and are made visible through the use of a translucent material for the cartridge 132. The material of the cartridge 132 may also comprise a high density polymer.

The features of this embodiment are further made obvious by the concave shaping of the upper portion 130, such that the assembly 30 does not lie flush with the cavity rim 22. A variation of this embodiment is for the upper portion 130 of the cartridge 132 to resemble the badge 50 of FIG. 1 by being substantially planar—or alternatively convex—instead of being concave; the upper portion 130 is integral with the lower portion 133 of the cartridge 132. The pins 42 are embedded within the cartridge using methods, such as press-fitting, known to those skilled in the art. The cartridge is preferably secured with adhesive tape in the bottom of the recess 60.

Figure 5:
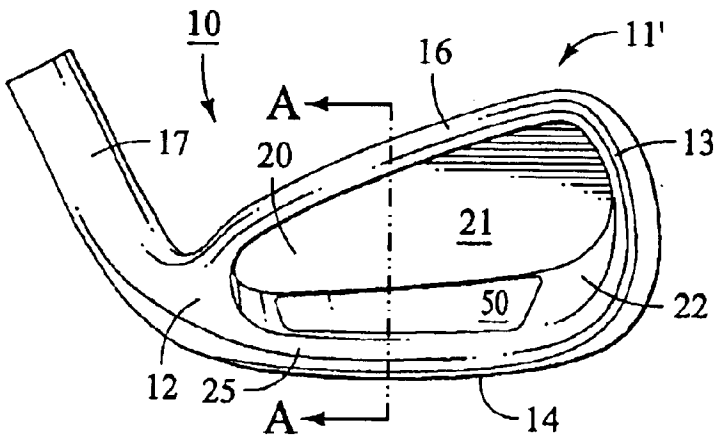
FIG. 5 is a rear view of a fifth preferred embodiment of a golf club head in accordance with the invention.
Figure 5A:
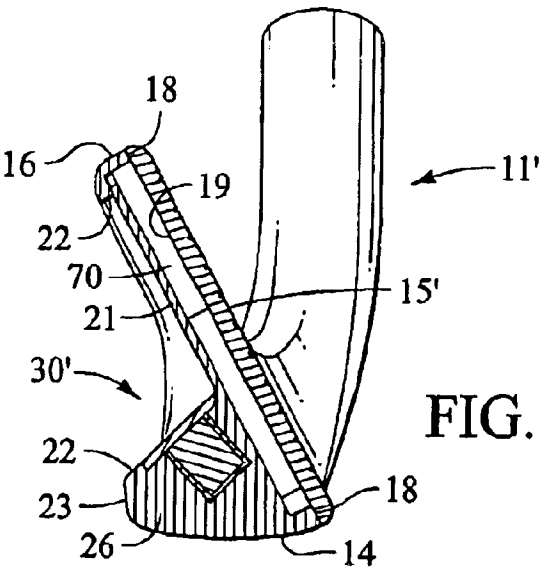
FIG. 5A is a cross-sectional view of the golf club head of FIG. 5, viewed along line A—A, depicting an insert assembly in the recess in the cavity rim and sole bar.
Figure 5B:
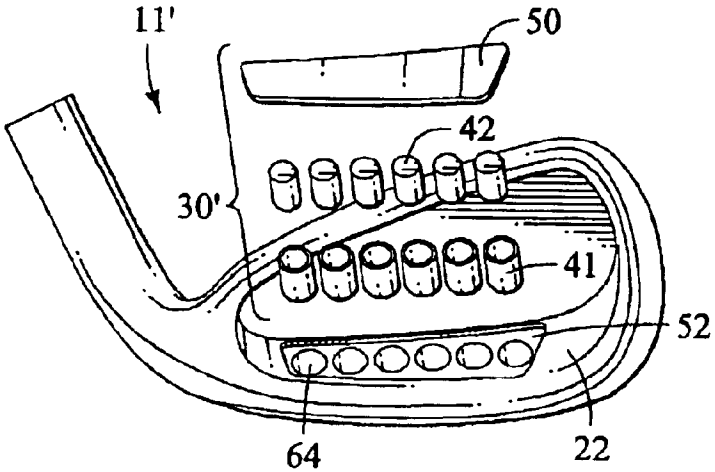
FIG. 5B is an exploded view of the golf club head of FIG. 5.

Another club head 10 constructed in accordance with the present invention is shown in FIGS. 5, 5A and 5B and has a planar cavity wall 21 surrounded by a perimeter weighting 25. It has a front recess 70 that is formed by the main body 11' and enclosed by the striking face 15'. A rear 19 of the striking face 15' is supported by a periphery 18 formed by a front edge of the heel 12, toe 13, sole 14 and top line 16 of the body 11'.

Alternatively, the striking face 15' may be supported by a ledge (not shown) surrounding the recess 70 that is formed along the periphery 18 of the body 11'. The striking face 15' is preferably welded to the body 11'. This construction allows higher deflection of the face at impact since the material of the striking face 15' may have a lower modulus of elasticity than the material of the main body 11', and/or the striking face 15' may be formed thinner than the striking face 15 of conventional cavity back irons.

The insert assembly 30' is constructed in the sole bar 26 with the damping cells 40 covered by a badge 50. Modifications to this construction may be made in any manner previously described, such as the substitution of the cells 40 with a cartridge 32 and pins 42 of the alternate insert assembly 30. Similarly, the badge 50 may be constructed to overlie a portion of the cavity wall 21, or a recess 60 similar to FIG. 4 may be formed up to a lower part of cavity weight 27 with the badge covering the top of the cartridge.

Figure 6:
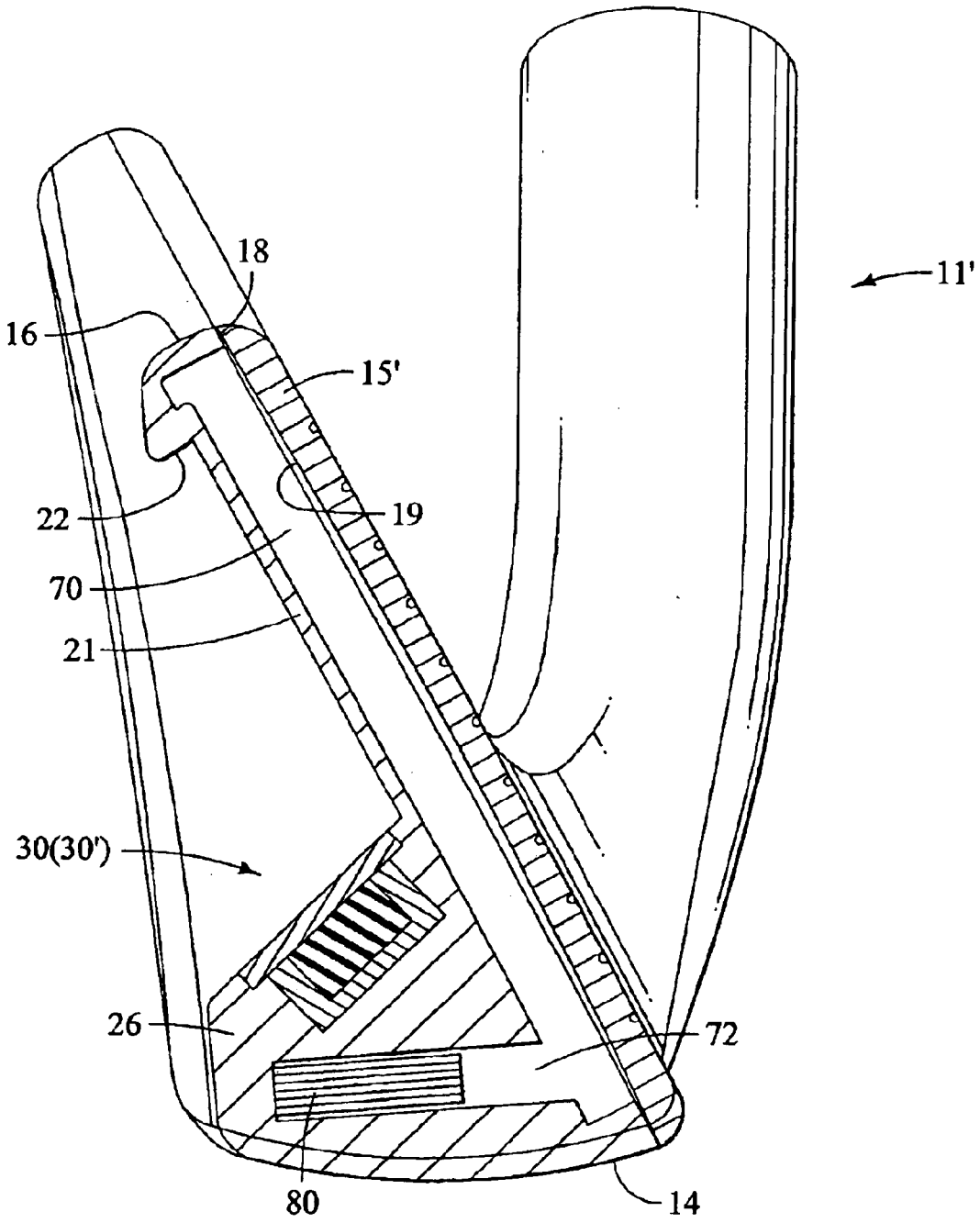
FIG. 6 is a cross-sectional view of a sixth preferred embodiment of a golf club head similar to FIG. 5.

A variation of the embodiment of FIG. 5A is shown in FIG. 6 and also has a front recess 70 that is closed by the striking face 15'. A lower end of the recess 70 includes a slot 72 that has a weight 80 placed within it. An adhesive is preferably used to secure the weight 80 within the slot 72. The slot 72 is formed in the sole bar 26 below the insert assembly 30/30', and it may extend partially or entirely along the length of the insert assembly 30/30'. The slot 72 extends rearwardly from the front recess 70 in a directly generally parallel to the sole 14.

Figure 7:
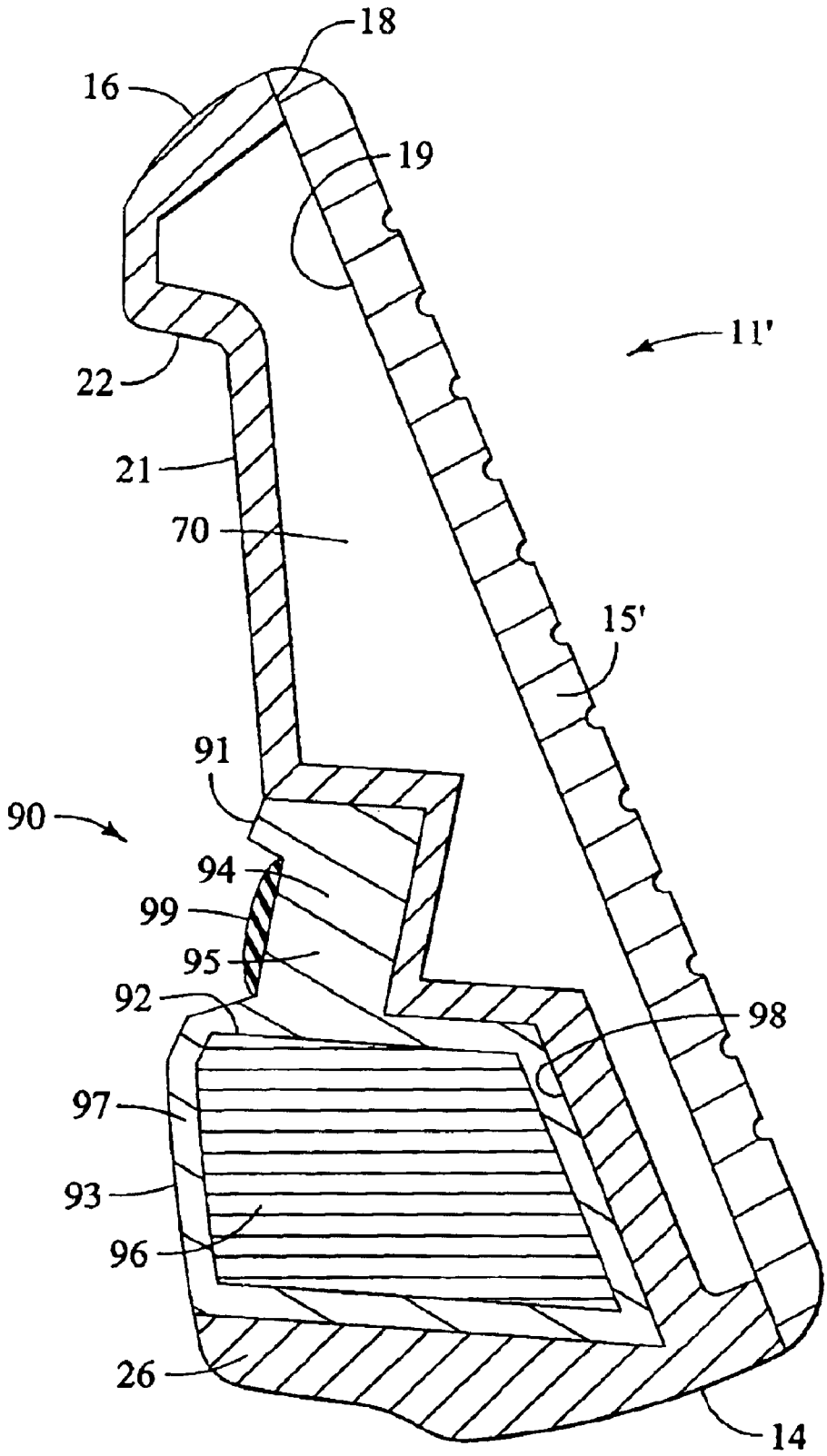
FIG. 7 is a cross-sectional view of a seventh preferred embodiment of a golf club head similar to FIG. 5.

Yet another variation of the club head of FIG. 5A is shown in FIG. 7 and also has a front recess 70 that is closed by the striking face 15'. The cavity wall 21 may include a center weight 27 or may be substantially flat. A recess 98 is formed in a central lower portion of the cavity 20 that includes a part of the cavity wall 21, the cavity rim 22 and the transition 23.

Within the recess 98 is an insert assembly 90 that includes a cartridge 94 and weight 96 along with a much smaller badge 99 than previously described. An upper section 91 of the insert assembly 90 replaces the portion of the cavity wall 21, a middle section 92 replaces a portion of the cavity rim 22, and a lower section 93 replaces a portion of the cavity transition 23. The badge 99 is purely decorative and preferably metallic. It has a logo engraved or embossed on its outer surface.

The weight 96 is preferably embedded within the cartridge 94 using methods known to those skilled in the art. The materials of the cartridge 94 and weight 96 are chosen from the options previously described. There may be one or a plurality of weights 96 embedded within the cartridge. The mass of the sole bar 26 that is removed by the formation of the recess 98 is substantially replaced or increased by the mass of the weight 96. Although the weight 96 is shown in a lower portion 97 of the cartridge 94 generally parallel to the sole 14, it may also extend into an upper portion 95 of the cartridge 94. An adhesive is preferably used to secure the assembly 90 within the recess 98.

The embodiments of FIGS. 5, 6, and 7 having the recess 70 behind the striking face 15/15' provide a more rearward center of gravity that may be beneficial to some golfers. Like the embodiments of FIGS. 1–4, they also provide improved flex, feel and vibration damping properties over conventional club heads. The embodiment of FIG. 6, in particular, is more easily manufactured as a hollow iron. Although, the second weight 80 may be inserted and then the striking face 15' may be attached such that the entire rear 19 of the striking face 15' contacts the cavity wall 21 and there is no hollow formed in the club head.

Figure 8:
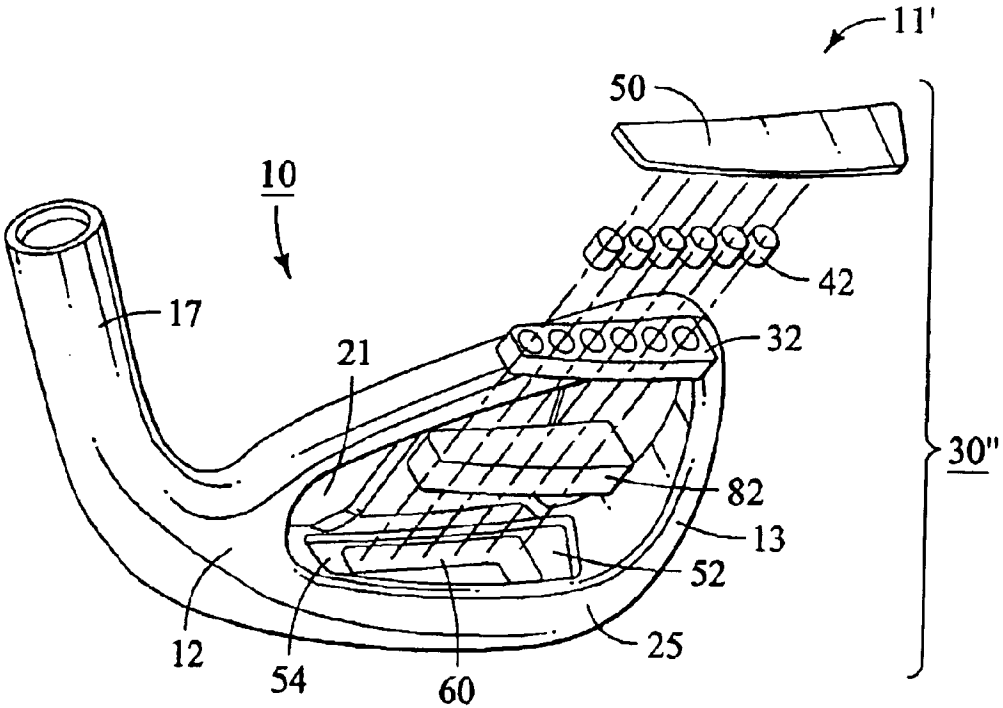
FIG. 8 is an exploded view of a eighth preferred embodiment of a golf club head similar to FIG. 5.
Figure 8A:
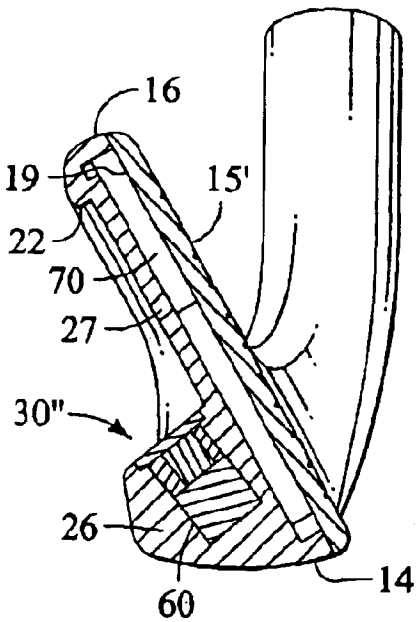
FIG. 8A is a cross-sectional view of the assembled golf club head of FIG. 8, depicting an insert assembly in the recess in the cavity rim and sole bar.

FIGS. 8 and 8A depict yet another preferred embodiment similar to the hollow constructions of FIGS. 5, 6 and 7. As in FIG. 6, an additional weight 82 is included. The insert assembly 31" thus includes pins 42, a cartridge 32 and the weight 82. Preferably the material of the weight 82 is a tungsten powder polymer, although any material may be used so long as it has a density greater than that of the body. The inclusion of the weight 82 in the sole bar 26 allows additional options with regard to the weight distribution of the club head 10 and the resultant flex and damping properties.

The weight 82 is placed within the recess 60, proximate the cartridge 32 and pins 42. The weight 82 may be located as shown at the bottom of the recess; however, it may alternatively be placed above the pins, as desired. In addition, cells 40 may be used, wherein a plurality of apertures 64 are provided in the sole bar to receive the cells 40. The weight 82 may include a corresponding number of smaller weight elements co-located within the apertures 64 with the cells 40, or a single, adjoining recess for the weight 82 may be included above the apertures and cells.

Figure 9:
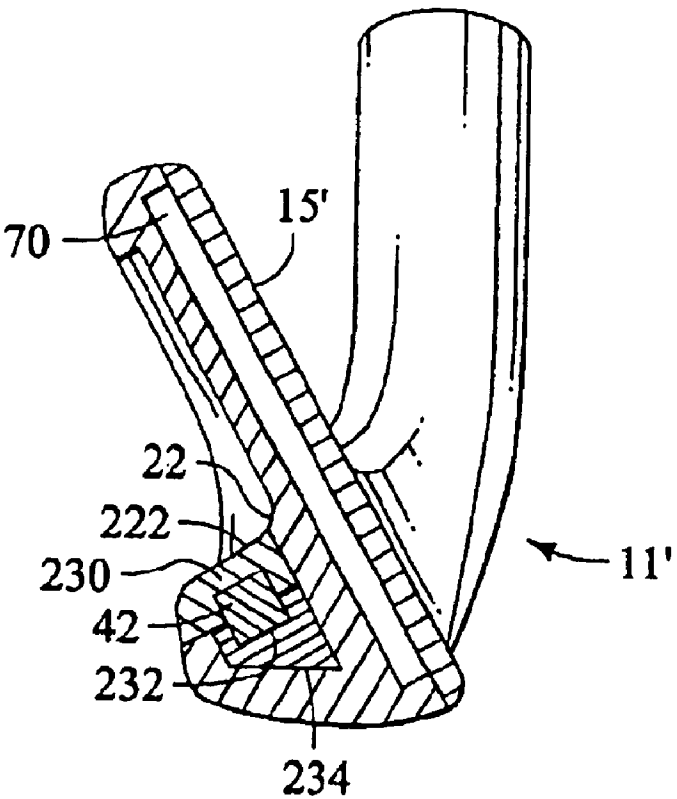
FIG. 9 is a cross-sectional view of a ninth preferred embodiment of a golf club head similar to FIG. 1.

Another embodiment shown in cross-section in FIG. 9 preferably comprises 5 pins 42 that are closely received in apertures of a cartridge 232. The cartridge 232 is preferably formed of a loaded polymer, such as tungsten powder in a nylon or urethane resin. A lower surface 234 of the cartridge 232 is shaped to conform to the bottom surface of the recess 60 formed in the rear of the club head. It is understood that the geometry of the recess 60 is at least partly dictated by the loft angle of the club head and its effect on the shape of the sole bar 26.

A cover 230 is preferably formed of a clear polymer and may be of a lesser density that the lower cartridge portion. The cover 230 has mating apertures to closely receive the pins 42 and thereby secure them. An adhesive is preferably used between the contacting surfaces of the cover 230 and cartridge 232. An upper surface 222 of the cover 230 is contoured for a smooth transition along the cavity rim 22.

Figure 10:
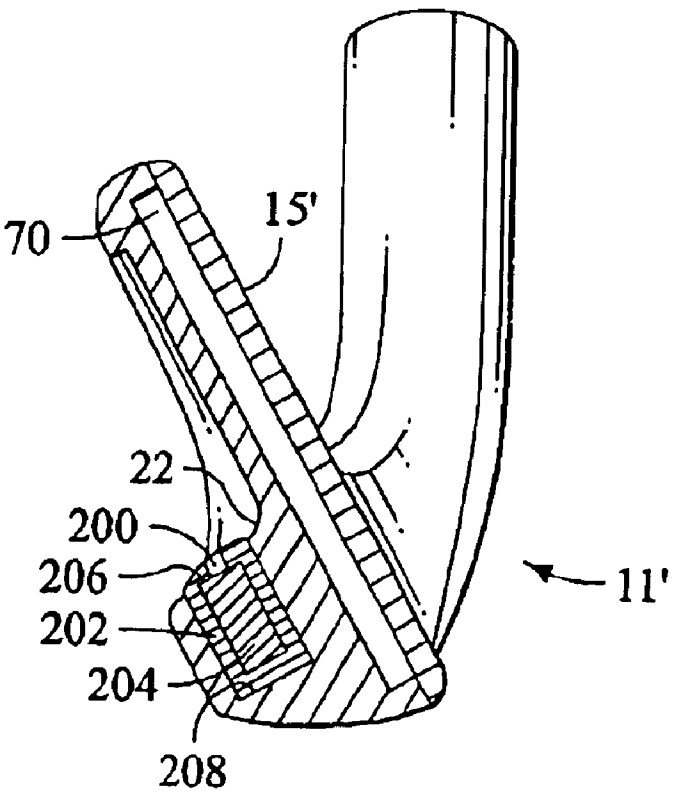
FIG. 10 is a cross-sectional view of a tenth preferred embodiment of a golf club head similar to FIG. 1 or FIG. 4.

The embodiment of FIG. 10 depicts an opening 200 provided at an upper end 206 of a cartridge 202. A plurality of pins 42 or a weight 204 may be placed within the cartridge 202. The weight 204 may comprise a single or multiple elements, such as tungsten bars. The cartridge 202 is preferably formed of a thin, high density polymer or standard urethane that accepts the pins or weight without undue effort during club head manufacture. The opening 200 may comprise a single slit at the upper end, or the opening 200 may comprise a plurality of apertures. For a plurality of apertures, a lower end 208 of the cartridge 202 may have at least one opening for insertion of the pins 42 or weight 204.

Figure 11:
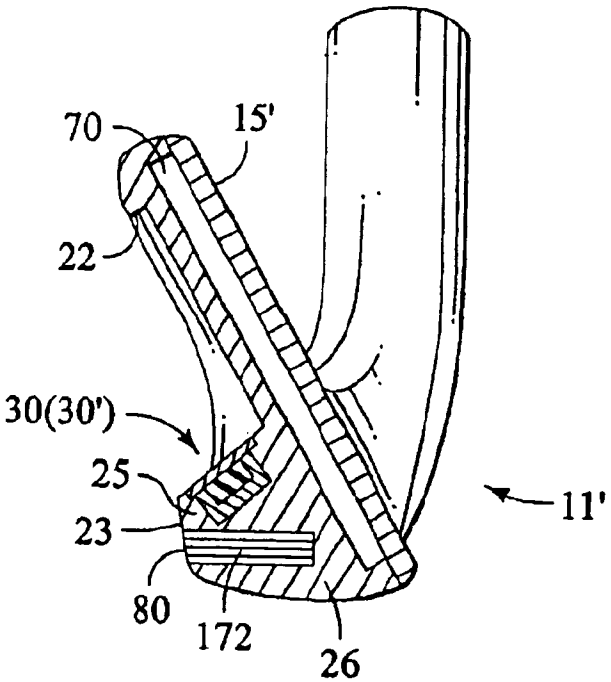
FIG. 11 is a cross-sectional view of another preferred embodiment of a golf club head similar to FIG. 6.

A variation of the embodiment of FIG. 6 is shown in FIG. 11. An insert assembly 30 (30') is provided at a lower portion of the cavity rim 22. Instead of a slot 72 extending rearwardly from a lower end of the recess 70, a slot 172 is formed in the perimeter weight 25 of the sole bar 26 through the cavity transition 23. A weight 80 is closely received in the slot 172 and may be further secured with adhesive.

Figure 12:
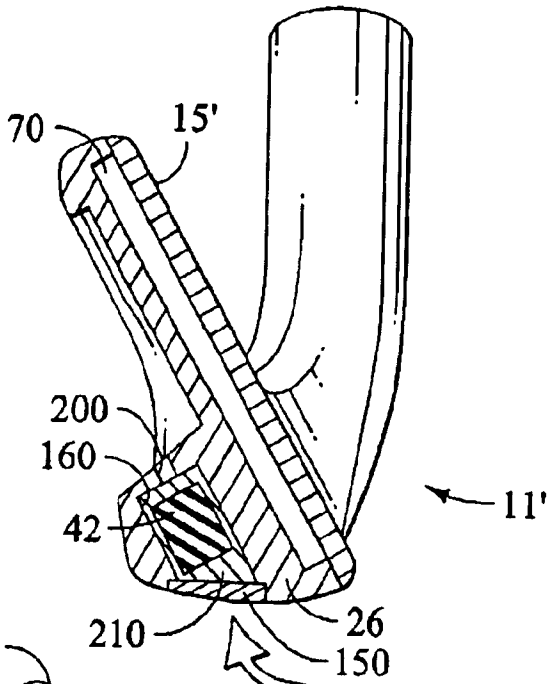
FIG. 12 is a cross-sectional view of another preferred embodiment of a golf club head.
Figure 13:
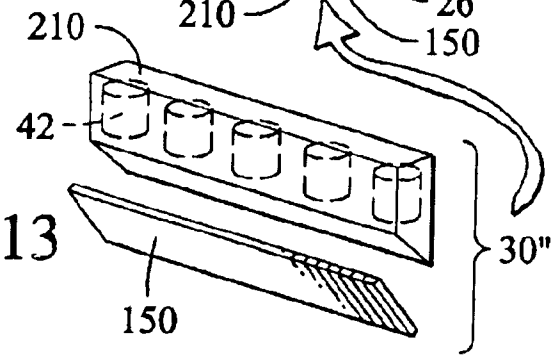
FIG. 13 is a view of elements of the insert for the golf club head of FIG. 13.

The embodiment of FIG. 12, with its insert assembly 30" shown separately in FIG. 13, has an optional opening 200 for viewing of the assembly 30". The insert assembly 30" preferably comprises pins 42 embedded within a cartridge 210 and protected by a cover 150. Because the cover 150 must endure the same impact forces as the sole bar 26 and keep out debris from the recess 160, the material of the cover preferably comprises a metal having a density approximately equal to or greater than the material of the club head body 11'.

Figure 14B:
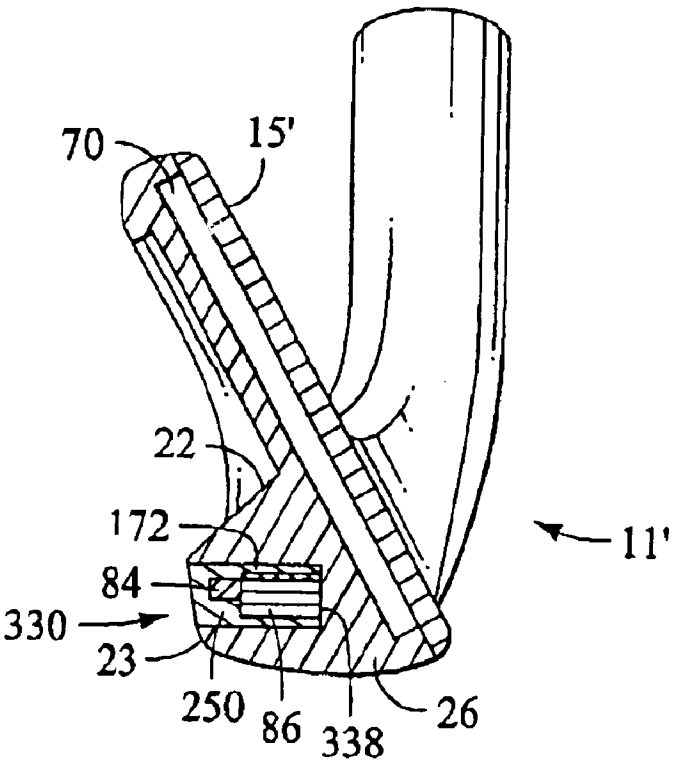
FIGS. 14A–B are cross-sectional views of other preferred embodiments of a golf club head of the present invention.
Figure 14A:
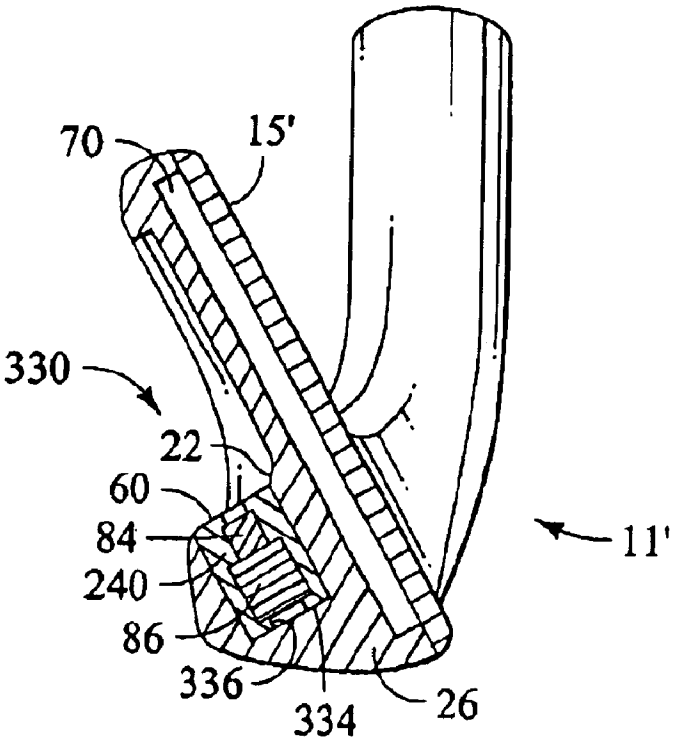

Two similar embodiments are shown in FIGS. 14A and 14B, comprising a dual weight configuration within a low density cartridge 240, 250. A weight assembly 330 configured as in FIG. 14A provides a higher mass contribution to the club head than the assembly 330 of FIG. 14B. Also, the assembly 330 of FIG. 14A is behind a greater area of the recess 70 and striking face 15' than the assembly 330 of FIG. 14B.

The cartridge 240, 250 is preferably formed of a polymer with a density of approximately 1 g/cc. The cartridge 240 includes an open lower end 334 having a lip 336 to aid in maintaining weights 84, 86 in place during manufacture. The cartridge 250 includes an open end 338 without a lip 336. In the weight assembly 330 the smaller weight 84 is located between the cartridge 240, 250 and the larger weight 86. Weight 84 preferably comprises a material such as aluminum having a density of about 2.7 g/cc, while weight 86 preferably comprises a material having a significantly larger density, such as 18 g/cc or so. Manipulation of the club head center of gravity may be made by changing the places of the two weights 84, 86 within the cartridge 240, 250. Also, the cartridge 240 may be used for the assembly 330 in the cavity transition 23 instead of the cartridge 250; similarly, the cartridge 250 may be used for the assembly 330 in the cavity rim 22 instead of the cartridge 240.

The embodiments of FIGS. 9–14B are shown and described with reference to a body 11' having a front recess 70 for receiving a separate striking face 15'; however, the present invention does not preclude these embodiments having a body 11 integrally including the striking face 15. Although the invention has been disclosed in detail with reference only to the preferred embodiments, those skilled in the art will appreciate that golf club heads can be made without departing from the scope of the invention. Accordingly, the invention is defined only by the claims set forth below.

We claim:

1. A golf club head comprising:

a body having a striking face, a rear cavity, a hosel and a sole portion, the rear cavity having a cavity wall and a cavity rim, a recess formed proximate the rear cavity, the recess having a recess wall and a recess bottom, the recess extending generally from the rear cavity toward a bottom of the sole portion; and an insert located within the recess, the insert including a core and an intermediate layer that separates the core from the recess bottom;

wherein the intermediate layer has a hardness and a modulus of elasticity that are less than that of the core, such that when the golf club head is used to strike a golf ball, the resulting vibrations are dissipated.

2. The golf club head of claim 1, further comprising a badge covering at least a portion of a proximal end of the insert, the badge visible at the rear cavity of the body.

3. The golf club head of claim 1, wherein the core comprises at least one pin, the intermediate layer covering a distal end of the pin and sides of the pin such that the pin is spaced from the recess wall.

4. The golf club head of claim 3, wherein the core comprises a plurality of pins and the intermediate layer extends between the pins.

5. The golf club head of claim 1, wherein the striking face is separately formed and attached to a main body portion comprising at least the sole portion.

6. The golf club head of claim 5, wherein the striking face has a modulus of elasticity different from a modulus of elasticity of the main body.

7. The golf club head of claim 5, wherein the main body portion comprises the rear cavity and the sole portion, a hollow portion being formed between the striking face and the cavity wall.

8. A golf club head comprising:

a body having a striking face, a rear cavity and a sole portion, a recess formed in the rear cavity extending generally toward a bottom of the sole portion, at least one aperture formed proximate the recess and extending generally from the recess toward the bottom of the sole portion; and a cell inserted within the aperture, the cell having a pin and an outer sleeve;

wherein the sleeve has a hardness and a modulus of elasticity that are less than that of the pin, such that when the golf club head is used to strike a golf ball, the resulting vibrations are dissipated by compression of the sleeve and friction between the pin and the sleeve.

9. A golf club head comprising:

a main body having a front perimeter, a hosel, a rear portion forming a rear cavity and a sole portion, a first recess formed in the sole portion and extending generally from the rear cavity toward a bottom of the sole portion, the first recess having a recess wall;

a striking face attached to the front perimeter of the main body, a hollow portion formed between the striking face and a wall of the rear cavity;

a core and an intermediate layer located within the first recess, the intermediate layer separating the core from the recess wall; and a weight located in the sole portion having a density greater than or equal to a density of the core;

wherein the intermediate layer has a hardness and a modulus of elasticity that are less than that of the core, such that when the golf club head is used to strike a golf ball, the resulting vibrations are dissipated by compression of the intermediate layer.

10. The golf club head of claim 9, further comprising a second recess formed in the sole portion and extending generally rearward from the hollow portion, the weight located within the second recess.

11. The golf club head of claim 9, wherein the core comprises at least one pin.

12. The golf club head of claim 11, wherein the core comprises a plurality of pins and the intermediate layer extends at least between the pins.

13. The golf club head of claim 9, wherein the weight is located in the first recess proximate the core and the intermediate layer.

14. The golf club head of claim 9, further comprising a badge located at a proximal end of the first recess.

15. A golf club head comprising:

a main body having a front portion with a front perimeter, a hosel, a rear portion forming a rear cavity and a sole portion, a first recess formed in the sole portion and extending generally from the rear portion toward the front portion, the first recess having a recess wall and a recess bottom;

an insert located within the first recess, the insert including a core and an intermediate layer that separates the core from the recess bottom;

wherein the intermediate layer has a hardness and modulus of elasticity that are less than that of the core, such that when the golf club head is used to strike a golf ball, the resulting vibrations are dissipated.

16. The golf club head of claim 15, wherein the insert has an exposed end and further comprising a badge covering at least a portion of the exposed end of the insert, the badge being visible from a rear of the body.

17. The golf club head of claim 15, wherein the core has a density greater than that of the body.

* * * * *